United States Patent [19]

Betz

[11] Patent Number: 4,599,985

[45] Date of Patent: Jul. 15, 1986

[54] IGNITION COIL FOR MULTI-CYLINDER INTERNAL COMBUSTION ENGINE

[75] Inventor: Dieter Betz, Vaihingen/Enz, Fed. Rep. of Germany

[73] Assignee: Robert Bosch GmbH, Stuttgart, Fed. Rep. of Germany

[21] Appl. No.: 686,210

[22] Filed: Dec. 26, 1984

[30] Foreign Application Priority Data

Mar. 30, 1984 [DE] Fed. Rep. of Germany ..... 3411843

[51] Int. Cl.[4] ..... F02P 1/00

[52] U.S. Cl. ..... 123/622; 123/621; 123/634

[58] Field of Search ..... 123/622, 621, 634, 643, 123/649

[56] References Cited

U.S. PATENT DOCUMENTS

| | | | |
|---|---|---|---|
| 1,328,374 | 1/1920 | Gordon | 123/621 |
| 1,428,635 | 9/1922 | Hunt | 123/622 |
| 1,504,611 | 8/1924 | Dorfman | 123/634 |
| 1,557,201 | 10/1925 | Hunt | 123/634 |
| 2,093,700 | 9/1937 | Wallenta | 123/634 |
| 2,100,210 | 11/1937 | Cain | 123/634 |
| 4,167,928 | 9/1979 | Pagel | 123/643 |
| 4,233,949 | 11/1980 | Poirier d'Ange d'Orsay | 123/634 |
| 4,509,495 | 4/1985 | Betz | 123/622 |

*Primary Examiner*—Ronald B. Cox

*Attorney, Agent, or Firm*—Frishauf, Holtz, Goodman & Woodward

[57] ABSTRACT

To reliably provide ignition energy only to specific spark plugs (11, 12; 14, 15) of a multi-cylinder internal combustion engine (ICE), a double-E core has a main or common or central branch, and separate primary (6, 8) and secondary windings (10, 13) located in shunt core branches (18', 19'), each secondary winding being associated with respective spark plugs. The magnetic circuits of the primary windings including the common branch and single air gaps (20, 21), each in the shunt magnetic paths (18, 19), so that the flux change generated upon interruption of current flow through the respective primary windings need pass through one air gap only for the associated concentric secondary, buth through two magnetically serially placed air gaps for the other secondary.

2 Claims, 2 Drawing Figures

IGNITION COIL FOR MULTI-CYLINDER INTERNAL COMBUSTION ENGINE

The present invention relates to an ignition coil for a multi-cylinder internal combustion engine, and more particularly to an ignition coil which has a plurality of output windings for a plurality of spark plugs, and a plurality of primary windings which are separately controlled by separate control switches, so that selected spark plugs can be energized by selected primary windings and a distributor for distributing spark energy is not needed.

BACKGROUND

It has previously been proposed to make ignition coils for multi-cylinder internal combustion engines in such a way that a primary leg of the coil has a pair of primary windings secured thereto. The primary leg is coupled, magnetically, to two parallel shunt magnetic portions, each one having a secondary winding wound thereon. An air gap is placed in the shunt magnetic portions. The primary windings are selectively controlled by breaker switches—which may be transistors—in such a manner that the ignition instant for spark flash-over from the secondary windings occurs at different times. A common current source is provided for the primary windings and the respective interrupter or breaker switches. The windings are magnetically so coupled with each other that, upon interruption of current in one of the primary windings, the voltage induced in only one of the secondary windings is sufficient for flash-over of a spark at the respective associated spark plug. Such a coil is described, for example, in the referenced U.S. Pat. No. 4,233,949.

The air gaps in the secondary or shunt branches require a substantial amount of electrical energy to be transferred into magnetic energy in order to generate effective sparks at the spark plug.

THE INVENTION

It is an object to improve an ignition coil for a distributorless multi-cylinder internal combustion engine which is compact and increases the efficiency of electrical-to-magnetic and again magnetic-to-electrical energy.

Briefly, the core is, for example, of the double-E type having a main center branch and two parallel secondary branches, each forming a closed magnetic circuit in which, however, an air gap is provided in the respective magnetic circuits which include the secondary branches. In accordance with the present invention, each secondary branch has only a single air gap therein; the primary windings are located on respective secondary core branches concentric with respective associated secondary windings.

The flux generated by one of the primary windings thus need pass through only one air gap to induce a voltage in the associated secondary. Voltages induced in the other secondary are due to flux having passed through two air gaps and are insufficient to cause a spark at a spark plug.

It is customary to operate such coils in a condition which, when one breaker switch, serially connected with a primary winding, is closed, the other, controlling current flow to the other primary winding, will be open, so that magnetic flux through the main leg or branch of the core common to both windings will be generated by only one of the primary windings at any time.

The coil has the advantage that the electrical energy is converted to magnetic energy for reconversion into electrical spark energy with higher efficiency than heretofore possible, to generate more effective sparks; and, further, in providing a structure which is compact and readily accomodated within the limited space of the engine compartment of an automotive vehicle, in which the internal combustion engine (ICE) with which the park coil is to be used is, typically, located.

DRAWINGS

FIG. 1 is a part-electrical schematic, part-magnetic schematic diagram of the ignition coil in accordance with the present invention, in which the electrical schematic diagram illustrates the connections of windings to the coil; and FIG. 2 is a top view of the coil of FIG. 1.

DETAILED DESCRIPTION

Figure 1:
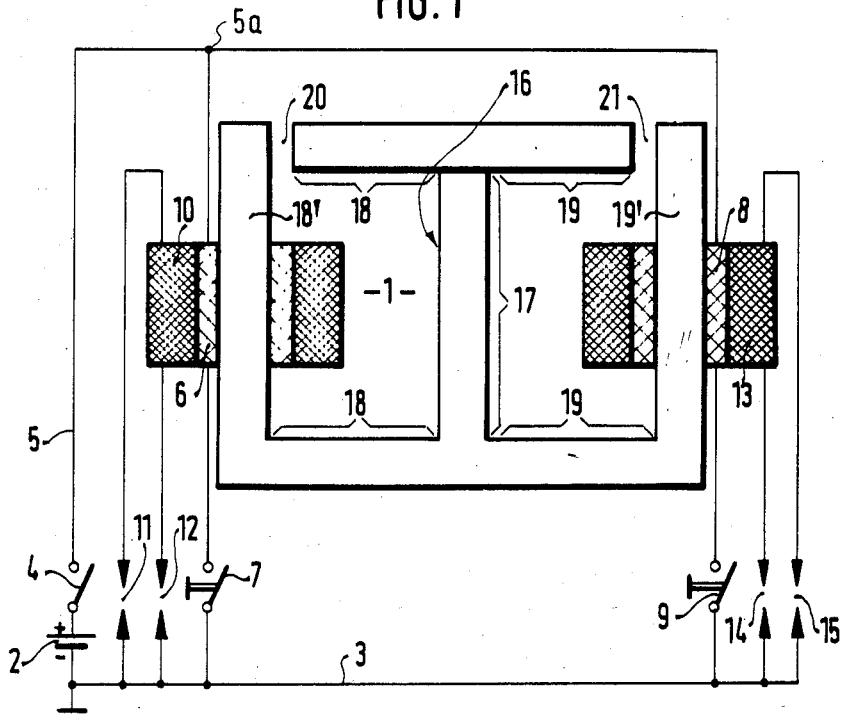

The ignition coil 1 of FIG. 1 is to be used with the ignition system of an ICE, for example installed in automotive vehicle. A current source 2, for example the battery of the vehicle, supplies ignition energy. The current source 2 is connected to a ground or chassis bus 3 and to a positive or operating bus 5 through an ignition or main switch 4.

The positive or operating bus 5 has a junction 5*a* to which two primary branch windings 6, 8 are connected. Primary winding 6 is serially connected through a breaker switch 7, shown schematically in FIG. 1 but which, for example, may be a transistor or other controlled switch operating, for example, under control of an electronically controlled ignition system. Primary winding 8, also connected to junction 5*a*, is connected through a breaker switch 9 which may be identical to switch 7. The terminals of the switches 7, 9 remote from the primary windings 6, 8 are connected to the ground or chassis bus 3.

The two breaker switches 7, 9 are operated to control ignition timing instants which are different. The switching timing of the switches 7, 9 is such that one of the switches 7, 9 can open only when the other is already in open condition. Usually, only one of the switches 7, 9 can be closed at any one time and subsequently opened rapidly, to induce an ignition pulse in the secondary windings. The previously open switch may then close, although this is not necessary; the cycle may repeat with the same switch, for subsequent sequential repetition by the other. The ignition coil, generally shown at 1, has two secondary windings 10, 13. Secondary winding 10 is connected through two ignition spark plugs 11, 12 to the ground or chassis bus 3. Secondary winding 13 is connected to two associated spark plugs 14, 15 to the ground or chassis bus 3. The arrangement is shown for a four-cylinder ICE; in a two-cylinder ICE, each one of the secondary windings 10, 13 would, for example, be connected to only spark plug, e.g. spark plug 12, 14, respectively, and the other terminal of the respective secondary windings would be directly connected to the ground or chassis bus 3.

The two primary windings 6, 8 are located on a secondary core concentric with the respective secondaries 10, 13, on branches 18′, 19′. The core has a main or referenc leg 16 and two parallel shunt legs 18′, 19′. A crossbar core portion is contiguous to leg 16. Shunt leg portion 18′ has the primary 6 and the secondary winding 10 located thereon. An air gap 20 is left within a secondary magnetic shunt path 18. Secondary magnetic shunt path 19 likewise has an air gap 21 located therein. Both secondary magnetic paths 18, 19 include the crossbar core portion and main leg 16 of the core to form a common magnetic path 17.

In accordance wth the present invention, only a single air gap 20,21 is located in each secondary or shunt magnetic path.

In a preferred form of the invention, the secondary or shunt magnetic circuits 17, 18, 19, including the air gaps 20, 21, preferably are symmetrical and of identical construction.

OPERATION

The ignition system is ready when the main switch 4 is closed. Let it be assumed, first, that by external control, for example due to the ignition system, and its coupling to the rotation of the ICE, the breaker switch 9 is closed, that is, passes current. By the definitions of the system, breaker switch 7 will be open. When breaker switch 9 is closed, current will flow through primary winding 8. Magnetic flux generated by primary winding 8 must pass through air gap 21 and iron core paths 17, 19. A substantial change in magnetic induction will result. The magnetic flux flowing through core path 18 must, in addition, pass through air gap 20, so that in the shunt path 18 only a smaller magnetic flux will occur.

Upon break or opening of the breaker switch 9, the voltage induced in the secondary winding 13, coupled to the magnetic path 19, will be due to a substantial change in magnetic flux so that the voltage induced in the winding 13 will be high and substantial and sufficient for providing a spark discharge or ignition spark at the spark plugs 14, 15. The voltage induced in the secondary winding 10, however, will be much too low for breakdown of the spark gaps of the spark plugs 11, 12.

Upon subsequent closing the breaker switch 7, a substantial change in flux will result when the primary winding 6 carries current. Breaker switch 9 remains open. Upon opening of the breaker switch 7, then, secondary winding 10 will have a high voltage pulse induced therein causing spark breakdown at the spark plugs 11, 12. The voltage induced in secondary winding 13, however, will be insufficient for generating a spark at the plugs 14, 15.

If necessary, diodes may be connected in series with the spark plugs 11, 12 and 14, 15 respectively, which are so poled that the low voltage which occurs when the breaker switch not associated with the respective spark plugs is blocked, but which are capable of passing the electrical voltage when the respective spark plugs should fire. Such diodes are not absolutely necessary and are not shown; they may be used to increase the reliability against spurious sparks.

Figure 2:
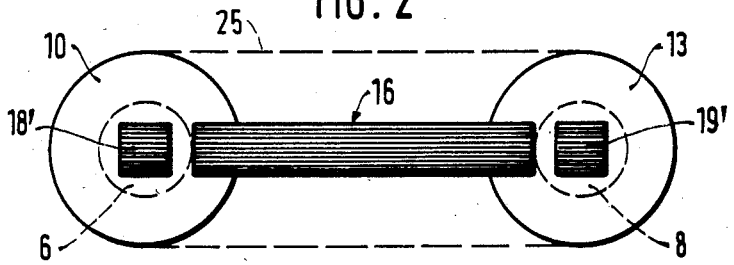

The windings 6, 8, 10, 13 can be individually potted in a potting compound or, preferably, and as shown by broken line 25, FIG. 2, can be commonly potted with a suitable casting compound, such as a casting resin. Each one of the secondary windings 10, 13 may, of course, only be connected to a single spark plug. More than two secondary magnetic core portions, each including an air gap and defining magnetic paths similar to paths 18, 19, may be coupled to a common core leg 17.

I claim:

1. Ignition coil, for a distributorless ignition system of an internal combustion engine, having at least two primary windings (6, 8);

at least two secondary windings (10, 13), one each being associated with a primary winding;

a unitary E-shaped core having a main core portion (16), and two secondary core portions (18', 19') magnetically coupled to the main core portion and located magnetically in shunt with respect to each other, and forming, with the primary core portion, two parallel secondary magnetic circuits (18, 19), each secondary core portion having a secondary winding wound thereon, wherein, in accordance with the the invention, each secondary magnetic circuit (18, 19) includes a single air gap (20, 21);

a further crossbar core portion, having two free ends, is provided, disposed contiguous to said main core portion (16) and defining, at each of said free ends, one of said single air gaps (20, 21); and each primary winding is concentric with an associated secondary winding and wound on the secondary core portion which forms part of a respective secondary magnetic circuit (18, 19) including said single air gap (20, 21).

2. Ignition system for an internal combustion engine comprising the ignition coil claimed in claim 1 and including selectively operable switching means (7, 9) connected to apply electrical energization to a respective one of the two primary windings (6, 8), and operable to connect only one of said primary windings, at any one time, to said source of energization.

* * * * *